US006033190A

United States Patent [19]

Merz

[11] Patent Number: 6,033,190

[45] Date of Patent: Mar. 7, 2000

[54] FLAT FACED BEARING HOUSING ENGAGING FLAT FACED PUMP ROTOR HOUSING

[75] Inventor: Johann Merz, Schwäbisch Gmünd, Germany

[73] Assignee: ZF Friedrichshafen AG, Friedrichshafen, Germany

[21] Appl. No.: 09/000,796

[22] Filed: Dec. 30, 1997

Related U.S. Application Data

[63] Continuation of application No. 08/732,463, filed as application No. PCT/EP95/01645, Apr. 29, 1995, abandoned.

[30] Foreign Application Priority Data

May 6, 1994 [DE] Germany ..... 44 16 077

[51] Int. Cl.[7] ..... F04B 49/00

[52] U.S. Cl. ..... 417/302; 417/300; 417/310

[58] Field of Search ..... 417/302, 300, 417/310, 308

[56] References Cited

U.S. PATENT DOCUMENTS

| | | | |
|---|---|---|---|
| 4,289,454 | 9/1981 | Iwata | 417/300 |
| 4,473,341 | 9/1984 | Ohe et al. | 417/299 |
| 4,505,649 | 3/1985 | Masuda et al. | 417/300 |
| 4,637,782 | 1/1987 | Teubler et al. | 417/300 |
| 4,715,793 | 12/1987 | Johann et al. | 417/300 |
| 5,236,315 | 8/1993 | Hamao et al. | 417/295 |

*Primary Examiner*—Charles G. Freay
*Assistant Examiner*—Robert Z. Evora
*Attorney, Agent, or Firm*—Larson & Taylor

[57] ABSTRACT

In a vane cell pump for pumping a pressure fluid from a container to a consumer, all the essential components and functional characteristics are accommodated in a bearing housing (10). The components include a suction connection (13) for connecting to the container, a pressure connection (14) for connecting to the consumer, a flow regulating valve (15) for regulating the pressure fluid pumped to the pressure connection (15), a pressure limiting valve (16) and suction and pressure conduits, which connect the work chambers to the suction connection (13), flow regulating valve (15), and pressure limiting valve (16). Also located in the bearing housing (10) is the sole radial bearing point of a drive shaft (12), by which a rotor (5) is supported in a cam ring (4). Between the cam ring (4), the rotor (5) and vanes (6) are inserted into it, so that work chambers are formed, which are defined in the axial direction by two control plates (7, 8). Opposite its adjacent control plate (7), the bearing housing (10) has a flat face (17), which is adjoined by a flat face (18) of a housing cap (11). The housing cap (11) is secured and centered relative to the bearing housing (10) solely by screws (21). Since neither the control plate (8) nor the drive shaft (12) is centered or supported in the housing cap (11), the simple centering of the housing cap (11) by the screws (12) suffices.

4 Claims, 1 Drawing Sheet

FLAT FACED BEARING HOUSING ENGAGING FLAT FACED PUMP ROTOR HOUSING

CROSS-REFERENCES TO RELATED APPLICATIONS

This application is a continuation of application Ser. No. 08/732,463 filed Nov. 5, 1996, now abandoned, which is a 371 of PCT/EP95/01645 filed Apr. 29, 1995.

BACKGROUND OF THE INVENTION

1. Field of the Invention

The invention relates to a vane cell pump for pumping a pressure fluid from a container to a consumer. A set of rotors of the vane cell pump includes a cam ring into which a rotor is rotatably inserted. The rotor has radially oriented slots in which vanes are displaceably inserted. Between the cam ring, the rotor and the vanes, work chambers are formed, which are defined in the axial direction by control faces of adjacent control plates. The rotor set is inserted into a pressure-fluid-filled interior of a housing, which comprises a bearing housing and a housing cap. In the bearing housing, the rotor is supported by means of a drive shaft that is braced in an axial direction on the housing cap. In the bearing housing, a suction connection for connection of the container and a pressure connection for connecting the consumer are provided. A flow regulating valve for regulating the pressure fluid pumped to the pressure connection is disposed in the bearing housing. A pressure limiting valve is also disposed in the bearing housing. Suction and pressure conduits that connect the work chambers with the suction connection, the flow regulating valve and the pressure limiting valve, are also disposed in the bearing housing.

2. Description of the Prior Art

A vane cell pump of this kind is known for instance from U.S. Pat. No. 5,098,259. This pump has a very compact design. However, a cylindrical tight fit between the housing cap and the bearing housing results in a widening of the housing cap in this region. The tight fit must be executed with great precision, since the drive shaft has not only its bearing point in the bearing housing but also a second bearing in a control plate, which in turn is centered in the housing cap. The production of the various close-fit points entails considerable production expense. Additional cost is entailed in the assembly of the bearing housing and housing cap, because a seal between the two parts must be mounted very carefully so that it will not be sheared off when the housing cap is slipped over the bearing housing.

SUMMARY OF THE INVENTION

The object of the invention is to improve the known pump in such a way that production and installation costs can be reduced.

This object is attained by the vane cell pump of the invention, in that the drive shaft is supported in the radial direction solely in the bearing housing and no longer in the control plate. As a result, the tight fit of the control plate in the housing cap can be dispensed with. Both the bearing housing and the housing cap have flat connection faces. A cylindrical tight fit is avoided. The housing cap is centered relative to the bearing housing solely by means of screws, with which it is secured to the bearing housing. The cam ring is likewise centered solely relative to the bearing housing.

Expedient and advantageous further features of the invention are disclosed in the detailed description. However, the invention is not limited to the combination of specific characteristics in the description. For one skilled in the art, other sensible possible combinations of features and individual specific characteristics will become apparent from the stated object.

In the known vane cell pump, the screws with which the housing cap is secured to the bearing housing pass through the pressure-fluid-filled interior. Each individual leadthrough of the screws through the housing cap must therefore be separately sealed off. These additional seals can be dispensed with, in the vane cell pump of the invention, because the screws for securing the housing cap to the bearing housing are disposed outside the interior of the vane cell pump.

The seal between the housing cap and the bearing housing can be accomplished by a simple flat seal. However, it is expediently embodied as an C ring in an annular groove in one of the two flat faces, that is, in either the housing cap or the bearing housing.

The invention will be described in further detail below in terms of an exemplary embodiment shown in the drawing.

DETAILED DESCRIPTION OF THE PREFERRED EMBODIMENTS

Figure 1:
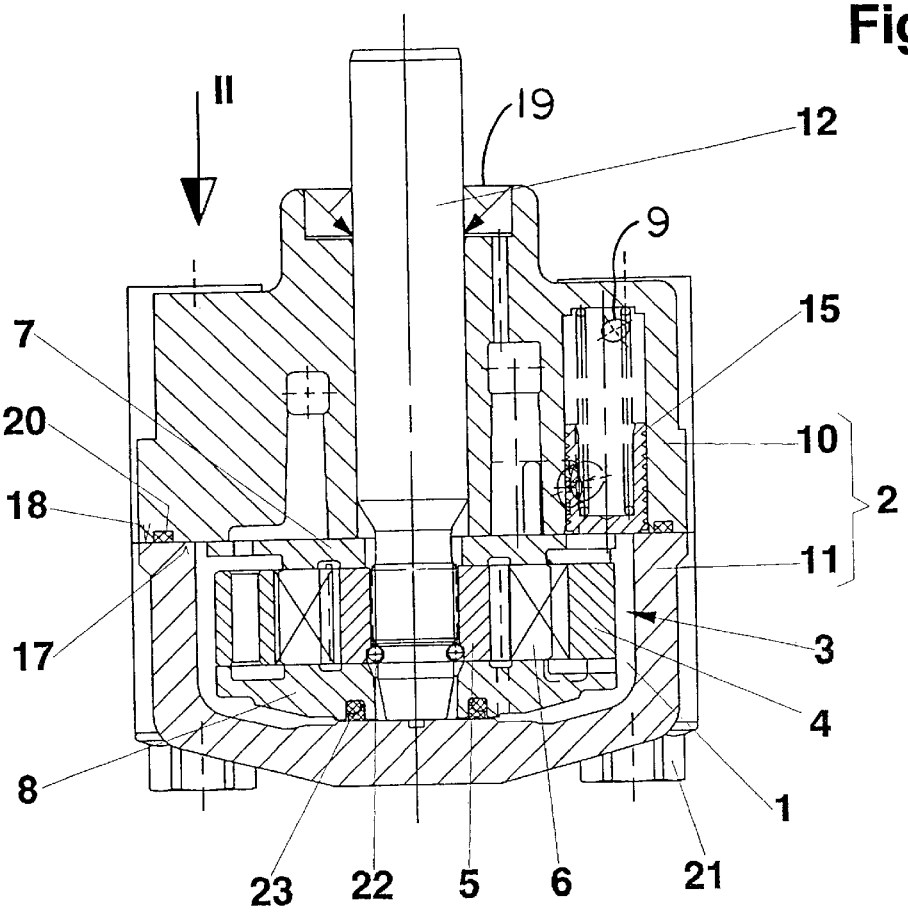
FIG. 1, a longitudinal section through the vane cell pump of the invention.
Figure 2:
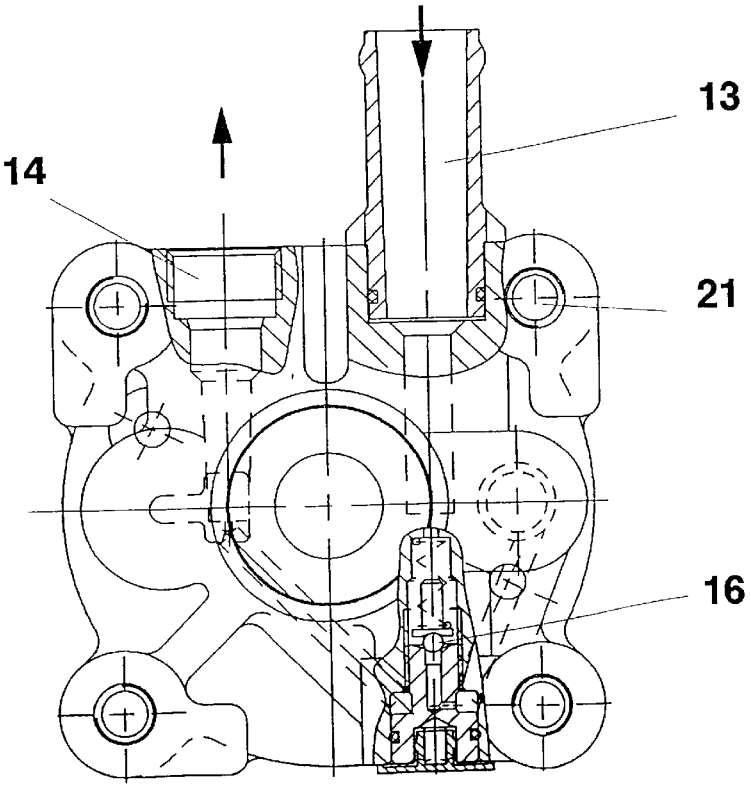
FIG. 2, a plan view on the vane cell pump in the direction of the arrow II in FIG. 1, cut away in portions.

The vane cell pump is used to pump a pressure fluid from a container, not shown, to a consumer, not shown but embodied for instance by a power steering system.

A rotor set 3 is inserted into a pressure-fluid-filled interior 1 of a housing 2. The rotor set 3 comprises a cam ring 4 and a rotor 5. The rotor 5 is disposed in the interior of the cam ring 4 and has radially oriented slots in which vanes 6 are displaceably inserted. Work chambers are formed between the cam ring 4, the rotor 5, and the vanes 6; they are defined in the axial direction by control faces of adjacent control plates 7 and 8.

The housing 2 is composed of a bearing housing 10 and a cup-shaped housing cap 11. The rotor 5 is supported in the bearing housing 10 via a drive shaft 12. The bearing point in the bearing housing 10 is the sole bearing of the drive shaft 12. This means that the drive shaft 12 is not supported in the radial direction in the housing cap 11. Instead, the drive shaft 12 is supported only axially on the housing cap 11. A seal 19 may be provided around drive shaft 12.

All the essential functional characteristics of the vane cell pump are contained in the bearing housing 10: Both a suction connection 13 for connection to the container and a pressure connection 14 for connecting the consumer are disposed in the bearing housing 10. Also disposed in the bearing housing 10 is a flow regulating valve 15 for regulating the pressure fluid pumped to the pressure connection 14. A pressure limiting valve 16 is likewise included in the bearing housing 10. The embodiment of the flow regulating valve 15 and of the pressure limiting valve 16 is well known, for instance from U.S. Pat. No. 5,098,259, and will therefore not be described further here. Suction and pressure conduits, which connect the work chambers to the suction connection 13, to the flow regulating valve 15, and to the pressure limiting valve 16, are also disposed in the bearing housing 10. These conduits are likewise well known and will therefore not be described further here other than to note that the ellipse 9 on the flow regulating valve 15 of FIG. 1 is a port opening up to a back-up chamber of the valve 15.

The pressure limiting valve 16 may be integrated in the flow regulating valve 15. In the preferred exemplary embodiment, however the two valves are disposed separately from one another.

The bearing housing 10 has a flat face 17 on its side toward the housing cap 11. The housing cap 11 likewise has a flat face 18 on its side toward the bearing housing 10. Located between the two flat faces 17 and 18 is a seal, preferably in the form of an 0 ring 20, which is placed in an axially open annular groove in the bearing housing 10 or in the housing cap 11.

The two housing parts, the bearing housing 10 and the housing cap 11 have very simple shapes and can therefore be precast or cast in finished form essentially in the pressure diecasting process.

The housing cap 11 is secured to the bearing housing 10 by screws 21 and is centered relative to the bearing housing 10 only by the screws 21. Further centering of the two parts to one another is unnecessary, since no other parts are adjusted or centered in the housing cap 11. As already described above, the drive shaft 12 is supported in the radial direction only in the bearing housing 10 and is braced only in the axial direction on the housing cap 11. In the tension direction, the drive shaft 12 is axially retained via a securing ring 22, the rotor 5, and the control plate 7. The control plate 8, which is adjacent the housing cap 11, therefore requires no centering relative to the housing cap 11. All that is located between the housing cap 11 and the control plate 8 is a sealing ring 23, which on the one hand divides the interior 1, acted upon by high pressure, from the drive shaft 12 and on the other, as an elastic element, assures gap compensation between the housing cap 11 and the control plate 8. In addition, the sealing ring 23 has the task, when the pump is stopped, of pressing the control plate 8, the cam ring 4 and the control plate 7 against the surface 18, in order to compensate for production tolerances. The screws 21 are located outside the interior 1, so that no additional sealing is required in that area.

The cam ring 4 and the control plates 7 and 8 are centered relative to the bearing housing 10 by means of two pins, known per se and therefore not described further here. No further centering is necessary.

The design of the vane cell pump according to the invention makes a very simple assembly possible: The various parts need merely be stacked on the other and then screwed together. The O-ring 20 cannot be sheared off during assembly.

I claim:

1. A vane cell pump for pumping a pressure fluid from a container to a consumer, which pump comprises:

a housing composed of a bearing housing and a cup-shaped housing cap, and having a pressure-fluid-filled interior;

a rotor set located in the pressure-fluid-filled interior of the housing and including a cam ring in which a rotor provided with radially oriented slots is rotatably mounted;

vanes displaceably inserted in the radially oriented slots of the rotor such that the cam ring, the rotor and the vanes form work chambers which are defined in the axial direction by control faces of adjacent control plates;

a drive shaft braced in an axial direction on the housing cap and which supports the rotor in the housing;

disposed in the bearing housing are a suction connection for connecting the container to the vane cell pump, a pressure connection for connecting the consumer to the vane cell pump, a flow regulating valve for regulating the pressure fluid pumped to the pressure connection, a pressure limiting valve, and suction and pressure conduits which connect the work chambers to the suction connection, the flow regulating valve and the pressure limiting valve;

the improvement comprising:

the bearing housing includes a substantially flat face opposite the housing cap and the housing cap has a substantially flat face opposite the bearing housing such that the flat faces of the bearing housing and the housing cap face one another;

the housing cap is centered relative to the bearing housing solely by means of screws which mate the flat face of the housing cap to the flat face of the bearing housing;

the drive shaft is supported in the radial direction by the bearing housing and not by the housing cap;

the cam ring is centered solely relative to the bearing housing; and the interior of the housing of the vane cell pump is sealed off by a seal disposed between the substantially flat faces of the bearing housing and housing cap.

2. The vane cell pump of claim 1, wherein the screws for securing the bearing housing are disposed outside of the interior of the vane cell pump.

3. The vane cell pump of claim 2, wherein the seal disposed between the substantially flat faces of the bearing housing and the housing cap includes an O-ring located in an annular groove provided in one of the two substantially flat faces of the bearing housing and the housing cap.

4. The vane cell pump of claim 1, wherein the seal disposed between the substantially flat faces of the bearing housing and the housing cap includes an O-ring located in an annular groove provided in one of the two substantially flat faces of the bearing housing and the housing cap.

* * * * *